US012569005B2

(12) United States Patent
Bray et al.

(10) Patent No.: US 12,569,005 B2
(45) Date of Patent: Mar. 10, 2026

(54) ARTICLE

(71) Applicant: Nicoventures Trading Limited, London (GB)

(72) Inventors: Andrew Bray, London (GB); John Richardson, London (GB); Richard Hepworth, London (GB)

(73) Assignee: NICOVENTURES TRADING LIMITED, London (GB)

( * ) Notice: Subject to any disclaimer, the term of this patent is extended or adjusted under 35 U.S.C. 154(b) by 243 days.

(21) Appl. No.: 17/925,106

(22) PCT Filed: Jun. 11, 2021

(86) PCT No.: PCT/GB2021/051461
§ 371 (c)(1),
(2) Date: Nov. 14, 2022

(87) PCT Pub. No.: WO2021/250425
PCT Pub. Date: Dec. 16, 2021

(65) Prior Publication Data

US 2023/0180821 A1 Jun. 15, 2023

(30) Foreign Application Priority Data

Jun. 11, 2020 (GB) ..... 2008899

(51) Int. Cl.
*A24D 3/17* (2020.01)
*A24B 3/14* (2006.01)
(Continued)

(52) U.S. Cl.
CPC ..... *A24D 3/048* (2013.01); *A24D 1/002* (2013.01); *A24D 1/045* (2013.01); *A24D 1/20* (2020.01);
(Continued)

(58) Field of Classification Search
CPC ... A24C 5/1814; A24C 5/1885; A24C 5/1828; A24D 1/20; A24D 3/0216; A24D 3/0279; A24D 3/061; A24D 3/17
See application file for complete search history.

(56) References Cited

U.S. PATENT DOCUMENTS 4,047,536 A 9/1977 Asfour
4,808,809 A * 2/1989 Pryor et al. ..... A24C 5/18
(Continued)

FOREIGN PATENT DOCUMENTS

EP 0246107 A2 11/1987
EP 0649607 A2 4/1995
(Continued)

OTHER PUBLICATIONS

International Search Report for corresponding application PCT/GB2021/051461 filed Jun. 11, 2021; Report dated Sep. 24, 2021.
(Continued)

*Primary Examiner* — Michael H. Wilson
*Assistant Examiner* — Ronnie Kirby Jordan
(74) *Attorney, Agent, or Firm* — CANTOR COLBURN LLP

(57) ABSTRACT

The present invention relates to an article (10). The article comprises an aerosol-generating substrate (12) and a region (14) positioned longitudinally relative to the aerosol generating substrate. The region comprises a rod segment (16) formed from a plurality of elongate strips (17) of sheet material (18) extending longitudinally through said rod segment. The present invention also relates to a segment of sheet material for a rod segment. The segment of sheet material comprises a segment of a web (44) of sheet material (18) of discrete length comprising a plurality of elongate strips (17) and a band (22) of sheet material extending transversely to the plurality of elongate strips. The plurality
(Continued)

of elongate strips extend from the band of sheet material. The present invention also relates to an apparatus (40) for manufacturing rod segments and a method of forming a rod segment.

18 Claims, 8 Drawing Sheets

(51) Int. Cl.

| | |
|---|---|
| ***A24D 1/00*** | (2020.01) |
| ***A24D 1/04*** | (2006.01) |
| ***A24D 1/20*** | (2020.01) |
| ***A24D 3/02*** | (2006.01) |
| ***A24D 3/04*** | (2006.01) |
| ***A24D 3/06*** | (2006.01) |

(52) U.S. Cl.
CPC ..... *A24D 3/0208* (2013.01); *A24D 3/0216* (2013.01); *A24D 3/0233* (2013.01); *A24D 3/0254* (2013.01); *A24D 3/0279* (2013.01); *A24D 3/0295* (2013.01); *A24D 3/061* (2013.01); *A24D 3/17* (2020.01); *A24B 3/14* (2013.01)

(56) References Cited

U.S. PATENT DOCUMENTS 4,889,143 A * 12/1989 Pryor et al. ..... A24D 3/0208 131/331
2005/0070409 A1* 3/2005 Deal ..... A24C 5/18 493/44

FOREIGN PATENT DOCUMENTS

| | | | | |
|---|---|---|---|---|
| GB | 1234786 | | 6/1971 | |
| WO | 2019057796 | A1 | 3/2019 | |
| WO | 2019106625 | A1 | 6/2019 | |
| WO | WO 2019/1066625 | A1 * | 6/2019 | ..... A24B 3/14 |
| WO | 2019243538 | A1 | 12/2019 | |

OTHER PUBLICATIONS

Written Opinion for corresponding application PCT/GB2021/051461 filed Jun. 11, 2021; Report dated Sep. 24, 2021.

* cited by examiner

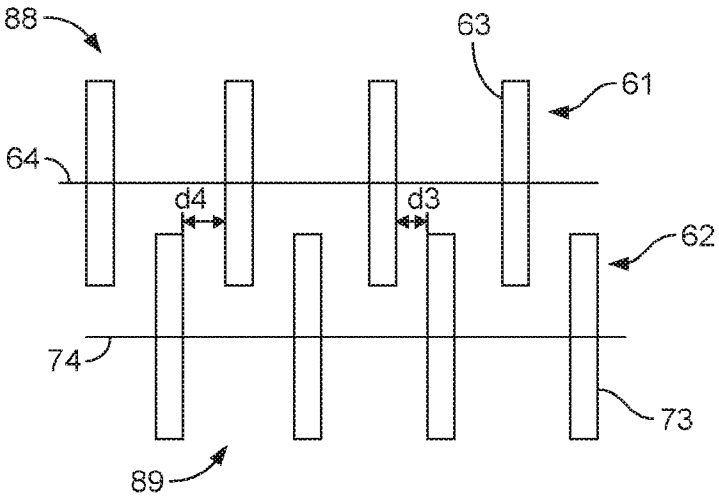
FIG. 11
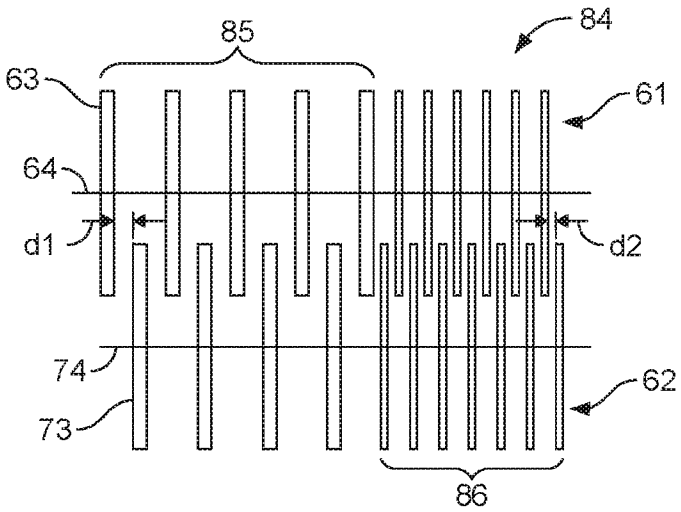
FIG. 10
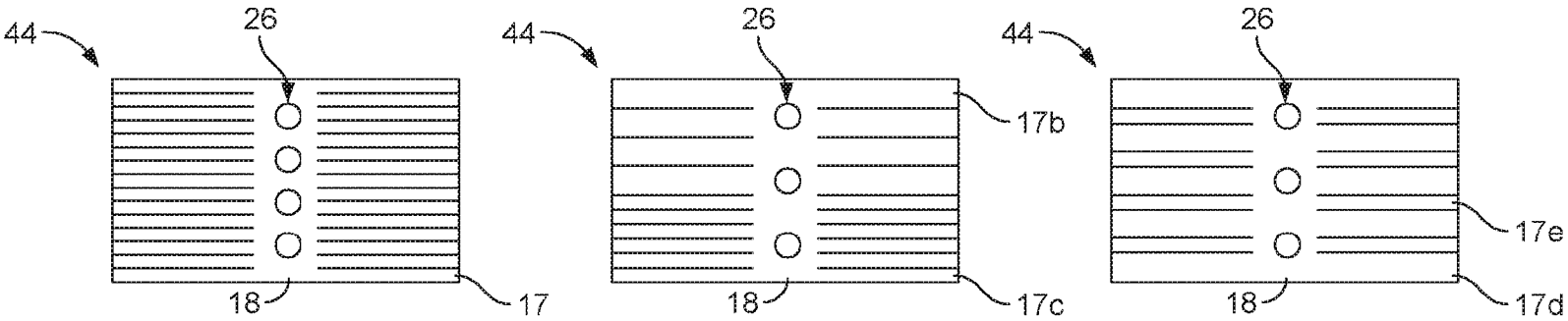
FIG. 12C
FIG. 12B
FIG. 12A

ARTICLE

TECHNICAL FIELD

The present invention relates to an article for use in an aerosol generating device. The present invention also relates to an apparatus for manufacturing the article and a method of manufacturing the article.

BACKGROUND OF THE INVENTION

It is known to provide articles for use in an aerosol generating device which can be heated to generate an aerosol. The aerosol is drawn downstream by a user to be inhaled and usually passes through a mouthpiece.

SUMMARY OF THE INVENTION

According to an embodiment of the present invention, there is provided an article comprising an aerosol generating substrate, and a region positioned longitudinally relative to the aerosol generating substrate, wherein the region comprises a rod segment formed from a plurality of elongate strips of sheet material extending longitudinally through said rod segment.

In some embodiments, the plurality of elongate strips of sheet material may extend substantially parallel to one another.

In some embodiments, each of the plurality of elongate strips of sheet material may be substantially straight.

In some embodiments, each of the plurality of elongate strips may comprise a crimped section.

In some embodiments, the crimped section of one of the plurality of elongate strips may be longitudinally offset from the crimped sections of the adjacent elongate strips.

In some embodiments, the rod segment may further comprise a band of sheet material from which the plurality of elongate strips extend.

In some embodiments, the band of sheet material may extend substantially transversely to the plurality of elongate strips of sheet material.

In some embodiments, the band of sheet material may extend substantially transversely through the rod segment.

In some embodiments, a first plurality of elongate strips may extend longitudinally downstream of the band of sheet material through the rod segment.

In some embodiments, a second plurality of elongate strips may extend longitudinally upstream of the band of sheet material through the rod segment.

In some embodiments, the band of sheet material may comprise a reduced density zone.

In some embodiments, the reduced density zone may comprise a recess formed by removal of sheet material.

In some embodiments, the rod segment may comprise a cavity formed by the reduced density zone in the band of sheet material.

In some embodiments, the rod segment may further comprise an aerosol-modifying agent capsule.

In some embodiments, the aerosol-modifying agent capsule may be located in the reduced density zone of the band of sheet material.

In some embodiments, the capsule may be received in the cavity formed by the reduced density zone in the band of sheet material.

In some embodiments, the rod segment may further comprise a tube, wherein the rod segment formed from a plurality of elongate strips of sheet material at least partially surround the tube.

In some embodiments, each of the plurality of elongate strips of sheet material may have a width substantially in the range of 0.25 mm to 2 mm.

In some embodiments, each of the plurality of elongate strips of sheet material may have a width that is substantially the same.

In some embodiments, the plurality of elongate strips of sheet material may comprise a first set of elongate strips having a first width that is substantially the same and a second set of elongate strips having a second width that is substantially the same.

In some embodiments, the rod segment may be formed from a first plurality of elongated strips of a first sheet material and a second plurality of elongated strips of a second sheet material.

In some embodiments, the substrate which forms the first sheet material may be different to the substrate that forms the second sheet material.

In some embodiments, the sheet material may be at least partially formed from at least one of paper, reconstituted tobacco material, tobacco sheets, band cast tobacco, extruded tobacco, tobacco paper, hemp, flax, cotton, polylactic acid, and/or dry gel sheets.

In some embodiments, the thickness of the sheet material may be in the range of about 30 to 300 μm.

In some embodiments, the density of the sheet material may be in the range of about 20 to 250 grams per square metre.

In some embodiments, the region positioned longitudinally relative to the aerosol generating substrate may be a downstream region downstream of the aerosol generating substrate.

In some embodiments, the region positioned longitudinally relative to the aerosol generating substrate may be an upstream region upstream of the aerosol generating substrate.

In some embodiments, the aerosol generating substrate and rod segment may be integrally formed from the same plurality of elongate strips of the sheet material extending longitudinal through the article such that the plurality of elongate strips form both the rod segment and the aerosol generating substrate.

In some embodiments, the aerosol generating substrate may comprise a tobacco material.

In some embodiments, the aerosol generating substrate may comprise an aerosol forming material.

In some embodiments, the aerosol forming material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

According to another embodiment of the present invention, there is provided a segment of sheet material for rod segment for a portion of an aerosol forming substrate portion of an aerosol generating device component; the segment of sheet material comprising: a segment of a web of sheet material of discrete length; the segment of sheet material comprising a plurality of elongate strips extending in a longitudinal direction; and a band of sheet material extending transversely to the plurality of elongate strips, the plurality of elongate strips extending from the band of sheet material.

In some embodiments, the band of sheet material may comprise a reduced density zone formed by the removal of sheet material from the band out sheet material.

In some embodiments, the reduced density zone may be formed by a recess cut through the thickness of the band of sheet material.

In some embodiments, a first set of plurality of elongate strips may extend longitudinally downstream of the band of sheet material.

In some embodiments, a second set of plurality of elongate strips may extend longitudinally upstream of the band of sheet material.

In some embodiments, the sheet material may be at least partially formed from at least one of paper, reconstituted tobacco material, tobacco sheets, band cast tobacco, extruded tobacco, tobacco paper, hemp, flax, cotton, polylactic acid, and/or dry gel sheets.

In some embodiments, the thickness of the sheet material may be in the range of about 30 to 300 μm.

In some embodiments, the density of the sheet material may be in the range of about 20 to 250 grams per square metre.

According to another embodiment of the present invention, there is provided an apparatus for manufacturing rod segments of an article for an aerosol generating device component, the apparatus comprising: a first cutter configured to cut a sheet material longitudinally to produce a plurality of elongate strips; a gatherer configured to gather the plurality of the elongate strips together to form a rod in which each of the strips extends substantially longitudinally through the rod; and a second cutter configured to cut the rod into segments to produce rod segments.

In some embodiments, the apparatus may further comprise a sheet material removal station configured to remove sheet material from the sheet material at predetermined intervals to form reduced density zones in the sheet material.

In some embodiments, the sheet material removal station may be located upstream of the first cutter.

In some embodiments, the sheet material removal station may remove sheet material by cutting recesses into the sheet material.

In some embodiments, the sheet material removal station may remove sheet material by displacing material from the reduced density zone.

In some embodiments, the first cutter may comprise a first cutter array comprising a cutting element configured to cut longitudinal slits through a sheet material of discrete length.

In some embodiments, the first cutter may be adjustable to either cut a sheet material to produce said plurality of elongate strips or to not cut said sheet material.

In some embodiments, the cutting element may comprise an arcuate cutting edge extending around a periphery of a substantially circular cutting disk, the cutting edge may comprise an arcuate gap configured to not cut a sheet material and allow a band of sheet material to be formed.

In some embodiments, the first cutter may comprises a plurality of cutting elements in the first cutter array, the arcuate gap of each cutting element may be aligned and configured to rotate at the same rotational speed.

In some embodiments, the first cutter may further comprise a second cutter array, the first cutter array being substantially located on a first side of the web of sheet material conveyance path and the second cutter array being substantially located on an opposing second side of the sheet material conveyance path.

In some embodiments, the plurality of cutting elements of the first and second cutter arrays may be arranged such that cuts are formed in the web of sheet material by a shearing action between adjacent cutting elements of the first and second cutter arrays.

In some embodiments, the width of the plurality of elongate strips may be determined by the width of the cutting elements of the cutter arrays.

In some embodiments, the band of sheet material may coincide with the reduced density zone formed in the sheet material by the sheet material removal station.

In some embodiments, the distance between cutting elements in a cutter array may be substantially in the range of 0.5 mm to 4 mm.

In some embodiments, the distance between each of the plurality of cutting elements may be substantially within the range of 0.05 mm to 1 mm.

In some embodiments, the distance between each of the adjacent cutting elements may be the same.

In some embodiments, the first cutter may comprise a first plurality of cutting elements and a second plurality of cutting elements in which each of the first cutting elements are spaced apart by a first distance and each of the second cutting elements are spaced apart by a second distance.

In some embodiments, cutting elements may be arranged in pairs comprising a cutting element from the first cutter array and a cutter element from the second cutter array, wherein the cutting elements in a pair may be spaced by a small distance and adjacent pairs may be spaced by a larger distance relative to the small distance between cutting elements of a pair.

In some embodiments, the first cutter may comprise a plurality of cutting elements, the first cutter being adjustable so as to adjust the distance between the cutting elements in order to adjust the number and/or width of elongate strips cut from a sheet material.

In some embodiments, the first cutter may be configured to crimp the cut sheet material.

In some embodiments, the apparatus may further comprise a crimping station.

In some embodiments, the apparatus may be configured to crimp a plurality of elongate strips of sheet material such that crimps on adjacent elongate strips are longitudinally offset from one another.

In some embodiments, the apparatus may be configured to feed sheet material to the first cutter in a web feed direction, and wherein the first cutter may be configured to cut the sheet material parallel to the sheet feed direction.

In some embodiments, the gatherer may be configured to gather the cut sheet material towards an axis that lies on a first plane, the first plane may include the feed direction and be perpendicular to a second plane defined by the cut sheet material before it is gathered.

In some embodiments, the axis may lie centrally of the cut sheet material.

In some embodiments, the gatherer may be configured to gather cut web of sheet material substantially transversely/circumferentially to form a rod.

In some embodiments, the gatherer may be configured gather the sheet material to form a rod of cut sheet material comprising a central cavity in the reduced density zone of the cut web of sheet material.

In some embodiments, the apparatus may further comprise a tube feeder configured to feed a tube into the centre of the gatherer.

In some embodiments, the gatherer may be configured to gather cut sheet material around a tube to form a rod.

In some embodiments, the apparatus may be configured to gather a first cut web of is sheet material together with a second cut web of sheet material.

In some embodiments, the apparatus may further comprise an aerosol-modifying agent insertion device.

In some embodiments, the aerosol-modifying agent insertion device may be located downstream of the gatherer.

In some embodiments, the aerosol-modifying agent insertion device may be configured to insert an aerosol-modifying agent capsule into the reduced density zone of the rod of sheet material.

In some embodiments, the aerosol-modifying agent insertion device may comprise a cavity preparation device.

In some embodiments, the cavity preparation device may comprise a roller having a radially extending projection configured to extend into the rod of sheet material when rotated into contact with the rod of sheet material to create an opening in the rod of sheet material.

In some embodiments, the aerosol-modifying agent capsule insertion device may comprise a capsule inserter configured to insert aerosol-modifying agent capsules into the rod of sheet material.

In some embodiments, the capsule inserter may be configured to insert aerosol-modifying agent capsules into a cavity in the reduced density zone of the rod of cut sheet material.

In some embodiments, the capsule inserter may be configured to insert aerosol-modifying agent capsules in between the plurality of elongate strips of cut sheet material.

In some embodiments, the apparatus may further comprise a controller to synchronise the motion of the first cutter, aerosol-modifying agent inserter, and second cutter.

According to another aspect of the present invention, there is provided a method of forming a rod segment for a downstream portion of an aerosol forming substrate portion of an aerosol generating device component, the method comprising: cutting a sheet material longitudinally to produce a plurality of elongate strips of sheet material, gathering the plurality of elongate strips to form a rod of sheet material in which each of the elongate strips extends substantially longitudinally through the rod, and cutting the rod of sheet material into segments to produce rod segments for a mouthpiece of an aerosol generating device component.

In some embodiments, the method may further comprise the steps of: cutting longitudinally extending slits of discrete length through the web of sheet material, and not cutting a discrete length of the sheet material to form a band of sheet material extending transversely to the plurality of elongate strips of sheet material.

In some embodiments, the method may further comprise the steps of: forming a reduced density zone in the web of sheet material by removing material from the web of sheet material.

In some embodiments, the method may further comprise the step of the reduced density zone being created in the band of sheet material by cutting a recess into the band of sheet material.

In some embodiments, the method may further comprise the step of the reduced density zone being created in the web of sheet material by pushing material away from an area of the web of sheet material.

In some embodiments, the method may further comprise the steps of: inserting a tube into the gatherer, and gathering the cut web of sheet material around the tube to form a rod of sheet material.

In some embodiments, the method may further comprise the step of inserting an aerosol-modifying agent capsule into the rod of cut sheet material.

In some embodiments, the method may further comprise the step of the aerosol modifying agent capsule being inserted into the reduced density zone of the band of the rod of cut sheet material.

In some embodiments, the method may further comprise the step of creating an opening in the rod of cut sheet material for an aerosol-modifying agent capsule to be inserted into.

BRIEF DESCRIPTION OF THE DRAWINGS

So that the invention may be more fully understood, embodiments of the present invention will now be described, by way of example only, with reference to the accompanying drawings, in which:

FIG. 10 shows a schematic front view of another embodiment of a first cutter;

FIG. 11 shows a schematic front view of a further embodiment of a first cutter;

FIGS. 12 *a-c* show schematic top views of a cut sheet material with a reduced density zone;

DETAILED DESCRIPTION

Figure 1:
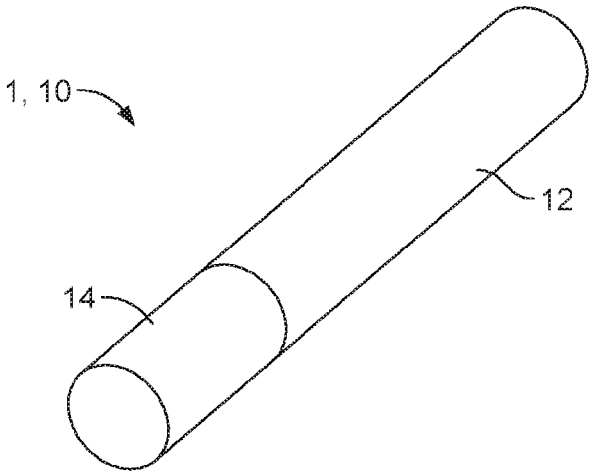
FIG. 1 shows a schematic perspective view of an article.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials.

According to the present disclosure, a "combustible" aerosol provision system is one where a constituent aerosol-generating material of the aerosol provision system (or component thereof) is combusted or burned during use in order to facilitate delivery of at least one substance to a user.

In some embodiments, the delivery system is a combustible aerosol provision system, such as a system selected from the group consisting of a cigarette, a cigarillo and a cigar.

In some embodiments, the disclosure relates to a component for use in a combustible aerosol provision system, such as a filter, a filter rod, a filter segment, a tobacco rod, a spill, an aerosol-modifying agent release component such as a capsule, a thread, or a bead, or a paper such as a plug wrap, a tipping paper or a cigarette paper.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energised so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

Aerosol-generating material is a material that is capable of generating aerosol, for example when heated, irradiated or energized in any other way. Aerosol-generating material may, for example, be in the form of a solid, liquid or gel which may or may not contain an active substance and/or flavourants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavours, one or more aerosol-former materials, and optionally one or more other functional material.

In some embodiments, the substance to be delivered may be an aerosol-generating material or a material that is not intended to be aerosolised. As appropriate, either material may comprise one or more active constituents, one or more flavours, one or more aerosol-former materials, and/or one or more other functional materials.

An aerosol-modifying agent is a substance, typically located downstream of the aerosol generation area, that is configured to modify the aerosol generated, for example by changing the taste, flavour, acidity or another characteristic of the aerosol. The aerosol-modifying agent may be provided in an aerosol-modifying agent release component, that is operable to selectively release the aerosol-modifying agent The aerosol-modifying agent may, for example, be an additive or a sorbent. The aerosol-modifying agent may, for example, comprise one or more of a flavourant, a colourant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

As noted herein, the active substance may comprise one or more constituents, derivatives or extracts of cannabis, such as one or more cannabinoids or terpenes.

As noted herein, the active substance may comprise or be derived from one or more botanicals or constituents, derivatives or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha Arventis, Mentha* c.v., *Mentha niliaca, Mentha piperita, Mentha piperita citrata* c.v., *Mentha piperita* c.v, *Mentha spicata crispa, Mentha cardifolia, Memtha longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

In some embodiments, the substance to be delivered comprises a flavour.

As used herein, the terms "flavour" and "flavourant" refer to materials which, where local regulations permit, may be used to create a desired taste, aroma or other somatosensorial sensation in a product for adult consumers. They may include naturally occurring flavour materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavour comprises menthol, spearmint and/or peppermint. In some embodiments, the flavour comprises flavour components of cucumber, blueberry, citrus fruits and/or redberry. In some embodiments, the flavour comprises eugenol. In some embodiments, the flavour comprises flavour components extracted from tobacco. In some embodiments, the flavour comprises flavour components extracted from cannabis.

In some embodiments, the flavour may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Referring now to FIG. 1, a delivery system component 1 is shown. The delivery system component 1 may be, for example, but not limited to a combustible provision system or a non-combustible aerosol provision component for use with a non-combustible aerosol provision device. The non-combustible aerosol provision component may be a consumable for use with a non-combustible aerosol provision device and is hereinafter referred to as an article 10.

Figure 2:
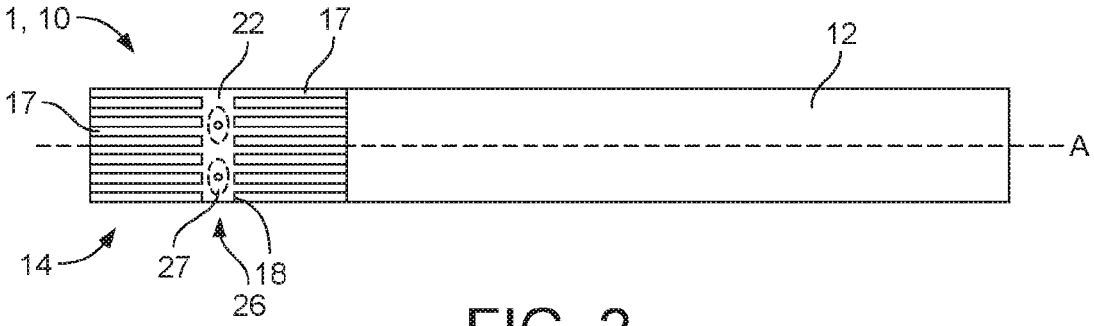
FIG. 2 shows a schematic cross-sectional view of an article shown in FIG. 1.

Referring to FIG. 2, a cross-sectional side view of the article is shown. The article 10 comprises an aerosol generating substrate 12. The article 10 further comprises a region 14 positioned longitudinally relative to the aerosol generating substrate 12. The region 14 comprises a rod segment 16 formed from a plurality of elongate strips 17 of sheet material 18 extending longitudinally through the rod segment 16. That is, the plurality of strips 17 of sheet material 18 extend substantially parallel to the longitudinal axis A of the article 10. Therefore, the plurality of elongate strip 17 of sheet material 18 may extend substantially parallel to one another. In some embodiments, each of the plurality of elongate strips 17 of sheet material 18 may be substantially straight.

In the embodiment illustrated, the region 14 positioned longitudinally relative to the aerosol generating substrate 12 is a downstream region 14 downstream of the aerosol generating substrate 12. In such an embodiment, during use, the aerosol generating substrate 12 is inserted into a chamber in an aerosol generating device (not shown) to be heated and the rod segment 16 may at least partially protrude from the aerosol generating device.

In an alternative embodiment, the region 14 positioned longitudinally relative to the aerosol generating substrate 12 may be an upstream region upstream of the aerosol generating substrate 12.

The aerosol generating substrate 12 may comprise a tobacco material. The tobacco material may be, for example, but not limited to, reconstituted tobacco, tobacco sheets, band cast tobacco, extruded tobacco, tobacco paper. Alternatively, the aerosol generating substrate 12 may comprise an aerosol forming material. The aerosol forming material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

Figure 3:
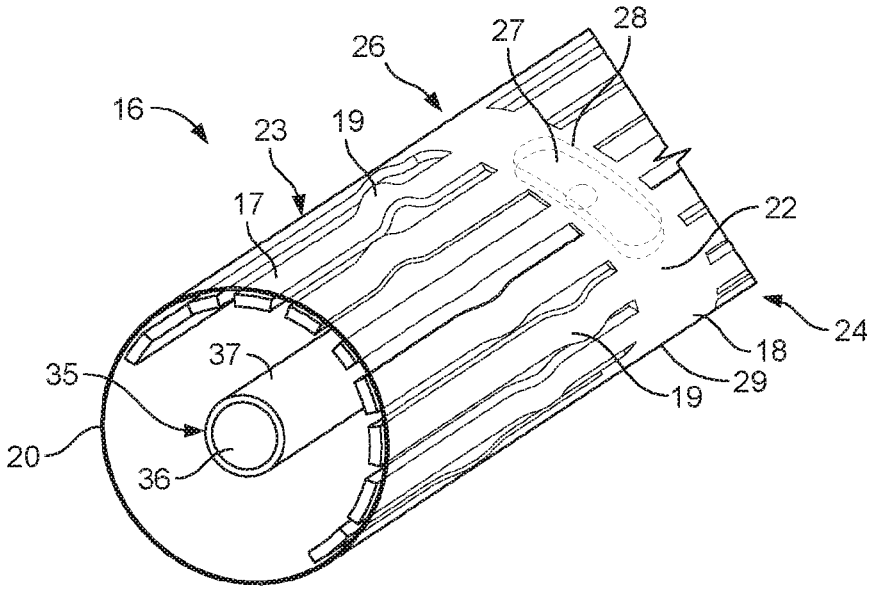
FIG. 3 shows a schematic perspective view of a rod segment of an article.

In some embodiments, such as the embodiment shown in FIG. 3, each of the plurality of elongate strips 17 of sheet material 18 may comprise a crimped section 19. For clarity, only the outermost elongate strips 17 of sheet material 18 are illustrated. The plurality of elongate strips 17 have also been shown arranged circumferentially to clearly show the relationship between adjacent strips. However, it will be clear to a person skilled in the art that the plurality of elongate strips 17 will be gathered differently. The crimped sections 19 prevent movement of the plurality of elongate strips 17 of sheet material 18 relative to one another and reduces the pressure drop through the rod segment 16.

In the embodiment shown in FIG. 3, it can be seen that the crimped section 19 of one of the plurality of elongate strips 17 of sheet material 18 is longitudinally offset from the crimped sections 19 of the adjacent elongate strips 17 of sheet material 18. That is, the crimped section 19 on one the plurality of elongate strips 17 of sheet material is located at a different longitudinal distance from a mouth end 20 of the rod segment 16 than the crimped section 19 on the adjacent elongate strip 17 of sheet material 18.

The crimped sections 19 are offset in the longitudinal direction in order to prevent the crimped sections causing a bulge in the rod segment 16, which can occur in rods with aligned crimp sections. The crimped sections 19 in the present embodiment are offset so as to form an arrow pattern or zig-zag pattern. In alternative embodiments, the crimped sections 19 may form a diagonal line, a parallel line pattern, or a random offset pattern.

In some embodiments, as shown in FIGS. 2 and 3, the rod segment 16 may further comprise a band 22 of sheet material 18. The plurality of elongate strips 17 of sheet material 18 may extend from the band 22 of sheet material 18. The plurality of elongate strips 17 of sheet material 17 and band 22 of sheet material 18 may be integrally formed and cut from the same sheet material 18.

In the present embodiment, the band 22 of sheet material 18 extends transversely to the plurality of elongate strips 17 of sheet material 18, i.e. perpendicularly to the longitudinal axis A, shown in FIG. 1, of the rod segment 16. That is, the band 22 of sheet material 18 is shown extending substantially circumferentially around the rod segment 16. However, the sheet material 18 is to be gathered in a manner in which it is folded randomly and is not likely to be arranged circularly or spirally in the rod 16. In an alternative embodiment, the band 22 of sheet material 18 may extend at an acute angle to the longitudinal axis A of the rod segment 16 such that the band 22 of sheet material 18 extends helically around the rod segment 16.

A first plurality 23 of elongate strips 17 of sheet material 18 extend longitudinally downstream of the band 22 of sheet material 18 through the rod segment 16. A second plurality 24 of elongate strips 17 of sheet material 18 extend longitudinally upstream of the band 22 of sheet material 18 through the rod segment 16.

The band 22 of sheet material 18 may be located in the middle of the rod segment 16 such that the first plurality 23 of elongate strips 17 of sheet material 18 are substantially the same longitudinal length as the second plurality 24 of elongate strips 17 of sheet material 18. In other embodiments, the band 22 of sheet material 18 may be located in a position other than the middle of the rod segment 16.

The band 22 of sheet material 18 may comprise a reduced density zone 26, shown in dotted lines in FIGS. 2 and 3. The reduced density zone 26 may comprise a recess 27 formed in the band 22 of sheet material 18. The recess 27 extends from the radially inner circumferential surface 28 of the band 22 of sheet material 18 towards the outer circumferential surface 29 of the band 22 of sheet material 18. In some embodiments, the recess 27 may extend through the full thickness of the band 22 of sheet material 18.

It will be understood that the reduced density zone 26 of the band 22 of sheet material 18 may comprise a plurality of recesses 27. In some embodiments, the recesses 27 may be evenly spaced along the band 22. In the embodiments illustrated, the recesses 27 are generally oval shaped. However, in alternative embodiment, the recesses 27 may take any other shape including, but not limited to, circular, rectangular, square, and triangular.

The recess 27 of the reduced density zone 26 of the band 22 of sheet material 18 can be formed by removal of sheet material 18. In some embodiments, the removal of sheet material can be performed by cutting away sheet material 18 from the band 22 in order to create the recess 27. In other embodiments, the removal of sheet material 18 from the band 22 can be performed by displacing sheet material 22 to create the recess 27. Displacement of sheet material 22 can be achieved by pushing sheet material 18 away from a point band 22 to create a recess 27 and reduced density zone. In such embodiments, the sheet material 18 that is pushes away from the recess 27 may be configured to form a reinforced area 30 around the recess 27 of the reduced density zone 26 in the band 22 of sheet material 18.

The sheet material 18 may be for example, but not limited to, reconstituted tobacco, tobacco sheets, band cast tobacco, extruded tobacco, tobacco paper, paper, laminated paper such as Alufoil or two different types of paper glued together, hemp, flax, cotton, polylactic acid (also referred to as polylactide or PLA) or other specialised biodegradable sheets material or starch based materials, dry gel sheets comprising menthol, glycerol, or another flavour, a plastic sheet, such as, for example, cellophane, natureflex, cellulose acetate, and HDPE, or a combination of one or more materials. The paper may be bleached, unbleached, coated, or treated, and may be impregnated with speciality fibres, such a Lyocell fibres, or with speciality additives, such as Carbon Paper. The sheet material 18 may be 100% non-woven materials, such as Lyocell, Airlaid, Cotton, Rayon, or Biocomponent fibres.

The sheet material 18 may optionally include additives including, for example, but not limited to, TEC, Triacetin, PEG, or TEGDA. The additives may be present in amounts from 5% to 15%. The sheet material 18 may also comprises aerosol formers such as, for example, but not limited to, glycerol, or PG. There may be in the range of 0.5 mg to 1 mg of glycerol per 10 mm segment of sheet material 18.

The thickness of the sheet material may be in the range of about 30 to 300 μm. Preferably, paper sheets will have a thickness in the range of 30 to 200 μm and sheets formed from tobacco, of which various are listed above, preferably have a thickness in the range of 50 to 300 μm, The density of the sheet material may be in the range of about 20 to 250 GSM (grams per square metre). Preferably, the various forms of sheet tobacco will have a density in the range of 50 to 250 GSM, whereas dry gel sheets preferably have a density in the range of 50 to 200 GSM, and paper sheets preferably have a density in the range of 20 to 200 GSM, more preferably between 20 and 100 GSM. Cellophane and natureflex may have properties more closely related to paper sheets, whilst PLA and HDPE may have properties more closely related to dry gel sheets. In the case of laminates, it will be understood that each layer may have a thickness or density in the ranges described above but that the full thickness of the laminate may be outside the range stated above for a single layer material.

In some embodiments, more than one type of sheet material 18 may be used to form the rod segments 16. In one exemplary embodiment, the rod segment 16 may comprise a first type of sheet material 18, for example, reconstituted tobacco, and a second type of sheet material 18, for example, a dry gel sheet comprising menthol. The two types of sheet material 18 may be arranged such that the second type of sheet material 18 is located inside the first type of sheet material 18. That is, the first and second types of sheet material 18 may be arranged concentrically with the second type of sheet material 18 forming a core portion and the first type of sheet material 18 extending circumferentially around the core portion to form a sheath portion. Alternatively, the first and second types of sheet material 18 may be formed such that the first type of sheet material 18 fills one semi-circular half of the rod segment 16 and the second type of sheet material 18 fills the other semi-circular half of the rod segment 16.

In some embodiments, the rod segment 16 comprises a cavity 31. The cavity 31 inside the reduced density zone 26 in the band 22 of sheet material 18. The cavity 31 may be defined by the recesses 27 in the reduced density zone. Alternatively, the cavity 31 may be defined by the inner circumferential surface 28 of the band 22 of sheet material 18.

In some embodiments, the rod segment 16 may further comprise an aerosol-modifying agent 33. In the present embodiment, the aerosol-modifying agent comprises a capsule 33. The aerosol-modifying agent capsule 33 may be located in the reduced density zone 26 in the band 22 of sheet material 18. In some embodiments, the aerosol-modifying agent capsule 33 is located in the cavity 31 in the central portion of the rod segment 16. In other embodiments, the aerosol-modifying agent capsule 33 is located in the recess 27 formed in the band 22 of sheet material 18.

In other examples, the aerosol-modifying agent can be provided in other forms, such as material injected into the body of the cut sheet material 18 or provided on a thread, for instance a thread carrying a flavourant or other aerosol-modifying agent, which may also be disposed within the body of the cut sheet material 18.

The aerosol-modifying agent capsule 33 may comprise a breakable capsule, for instance a capsule which has a solid, frangible shell surrounding a liquid payload. A single capsule 33 may be used. The capsule 33 may be entirely surrounded by the band 22 of sheet material 18. In some embodiments, the capsule 33 may be located in between the plurality of elongate strips 17 of sheet material 18. In other examples, a plurality of breakable capsules 33 may be disposed within the reduced density zone 26 of the band 22 of sheet material 18. Alternatively or in addition, one or more breakable capsules 33 may be located in between the plurality of elongate strips 17 of sheet material 18. In embodiments in which a plurality of capsules is used, the individual capsules may be the same as each other, or may differ from one another in terms of size and/or capsule payload.

In embodiments where the capsule 33 is located an upstream region upstream of the aerosol generating substrate 12, the capsule 33 and upstream region may be inserted into a cavity of an aerosol generating device (not shown). Therefore, the capsule 33 may be configured to release its contents when heat is applied to the capsule 33, i.e. the capsule may thermally degrade to release its contents.

The capsule 33 may comprise a core-shell structure. In other words, the capsule 33 may comprise a shell encapsulating a liquid agent, for instance a flavourant or other agent, which can be any one of the flavourants or aerosol-modifying agents described herein. The shell of the capsule 33 may be ruptured by a user to release the flavourant or other agent into the rod segment 16.

In the present embodiment, the capsule 33 is spherical and has a diameter in the range of 0.4 mm to 10 mm. In other embodiments, other shapes and sizes of capsule can be used. The total weight of the capsule 33 may be in the range of about 10 mg to 50 mg.

The breakable core-shell structure of the capsule 33 may comprise an encapsulating or barrier material that creates a shell around a core that comprises the aerosol-modifying agent. The shell structure hinders migration of the aerosol-modifying agent during storage of the article 10 but allows controlled release of the aerosol-modifying agent during use.

In some cases the encapsulating material is frangible. Therefore, the capsule 33 may be crushed or otherwise fractured or otherwise broken by the user to release the encapsulated aerosol-modifying agent. Typically, the capsule 33 is broken immediately prior to heating being initiated but the user can select when to release the aerosol modifier. The term "breakable capsule" refers to a capsule 33, wherein the shell can be broken by means of a pressure to release the core; more specifically the shell can be ruptured under the pressure imposed by the user's fingers when the user wants to release the core of the capsule 33.

In some cases, the encapsulating material is heat resistant. That is to say, in some cases, the encapsulating material will not rupture, melt, or otherwise fail at the temperature reached at the capsule site during operation of the aerosol provision device. Illustratively, a capsule located in a mouthpiece may be exposed to temperatures in the range of 30° C. to 100° C. for example, and the barrier material may continue to retain the liquid core up to at least about 50° C. to 120° C.

In other cases, the capsule releases the core composition on heating, for example by melting of the encapsulating material or by capsule swelling leading to rupture of the encapsulating material.

The total weight of a capsule 33 may be in the range of about 1 mg to about 100 mg, suitably about 5 mg to about 60 mg, about 8 mg to about 50 mg, about 10 mg to about 20 mg, or about 12 mg to about 18 mg.

The total weight of the core formulation may be in the range of about 2 mg to about 90 mg, suitably about 3 mg to about 70 mg, about 5 mg to about 25 mg, about 8 mg to about 20 mg, or about 10 mg to about 15 mg.

The capsule 33 may comprise a core as described above, and a shell. The capsules may present a crush strength from about 4.5 N to about 40 N, more preferably from about 5 N to about 30 N or to about 28 N (for instance about 9.8 N to about 24.5 N).

The capsules 33 may be substantially spherical and have a diameter of at least about 0.4 mm, 0.6 mm, 0.8 mm, 1.0 mm, 2.0 mm, 2.5 mm, 2.8 mm, or 3.0 mm. The diameter of the capsules may be less than about 10.0 mm, 8.0 mm, 7.0 mm, 6.0 mm, 5.5 mm, 5.0 mm, 4.5 mm, 4.0 mm, 3.5 mm, or 3.2 mm. Illustratively, the capsule diameter may be in the range of about 0.4 mm to about 10.0 mm, about 0.8 mm to about 6.0 mm, about 2.5 mm to about 5.5 mm, or about 2.8 mm to about 3.2 mm. In some cases, the capsule may have a dimeter of about 3.0 mm. These sizes are particularly suitable for incorporation of a capsule 33 into an article as described herein.

The cross-sectional area of the capsule 33 at its largest cross-sectional area is in some embodiments less than 28% of the cross-sectional area of the portion of the rod segment 16 in which the capsule 33 is provided, more preferably less than 27%, and still more preferably less than 25%. For instance, for a spherical capsule 33 having a diameter of 3.0 mm, the largest cross-sectional area of the capsule is 7.07 $mm^2$.

As can be seen in FIG. 3, the rod segment 16 may further comprise a tube section 35. The tube section 35 may be located co-axially with the rest of the rod segment 16. Therefore, the tube section 35 extends longitudinally through the rod segment 16. The tube section 35 is hollow and so comprises an aperture 36 extending therethrough. In the present embodiment, the tubular section 35 is generally cylindrical. However, it will be appreciated that in an alternative embodiment the tube section 35 may be any shaped prism, for example, but not limited to, triangular, square, or hexagonal. The tube section 35 may have a wall thickness in the range of about 0.5 mm to 1 mm, and the aperture 36 may have a diameter in the range of about 1 mm to 3 mm.

In embodiments of the rod 16 comprising the tube section 35, the aerosol modifying agent 33 may be located between an outer surface 37 of the tube section 35 and the band 22 of sheet material 18. That is, the aerosol-modifying agent 33 may be located in a recess 27 of the reduced density zone 26 between the sheet material 18 and the tube section 35.

Figure 4:
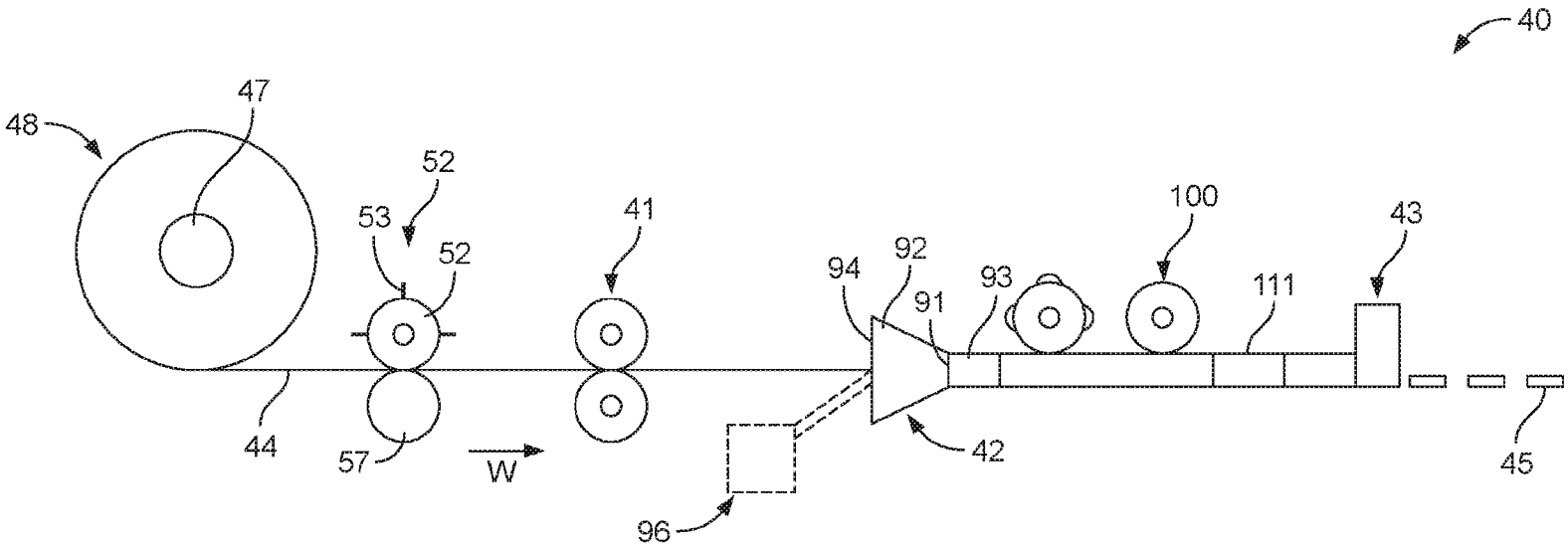
FIG. 4 shows a schematic side view of an apparatus for manufacturing rod segments for an article.

Referring now to FIG. 4, a schematic side view of an apparatus 40 for manufacturing rod segments 16 for an article 10 described above with reference to FIGS. 1 to 3. The article 10 may be part of an aerosol generating device component to be used with an aerosol generating device. The apparatus 40 comprises a first cutter 41, a gatherer 42, and a second cutter 43. The first cutter 41 is configured to cut a web 44 of sheet material 18 longitudinally to produce a plurality of elongate strips 17. The gatherer 42 configured to gather the plurality of elongate strips 17 together to form a rod 45 in which each of the strips 17 extends substantially longitudinally through the rod 45. The second cutter 43 is configured to cut the rod 45 into segments to produce rod segments 16, as described above.

As shown in FIG. 4, the apparatus 40 may further comprise a spindle 47 on which a web 44 of sheet material 18 is wound to form a bobbin 48. The bobbin 48 of sheet material 18 is configured to rotate to feed the web 44 of sheet material 18 from the bobbin 48 through the apparatus 40 along a web feed direction W. In some examples, the apparatus 40 may be arranged to drive the bobbin 48 to rotate. In other examples, the bobbin 48 may be free to rotate, and the web 44 of sheet material 18 being pulled from the bobbin 48 by a downstream component of the apparatus 40, for example a roller or drive belt (not shown) may cause the bobbin 48 to rotate.

The web 44 of sheet material 18 may be for example, but not limited to, reconstituted tobacco, tobacco sheets, band cast tobacco, extruded tobacco, tobacco paper, paper, laminated paper such as Alufoil or two different types of paper glued together, hemp, flax, cotton, polylactic acid (also referred to as polylactide or PLA), or other specialised biodegradable sheets material or starch based materials, dry gel sheets comprising menthol, glycerol, or another flavour, a plastic sheet, such as, for example, cellophane, natureflex, cellulose acetate, and HDPE, or a combination of one or more materials. The paper may be bleached, unbleaches, coated, or treated, and may be impregnated with speciality fibres, such a Lyocell fibres, or with speciality additives, such as Carbon Paper. The sheet material 18 may be 100% non-woven materials, such as Lyocell, Airlaid, Cotton, Rayon, or Biocomponent fibres.

The web 44 of sheet material 18 may optionally include additives including, for example, but not limited to, TEC, Triacetin, PEG, or TEGDA. The additives may be present in amounts from 5% to 15%. The web 44 of sheet material 18 may also comprises aerosol formers such as, for example, but not limited to, glycerol, or PG.

There may be in the range of 0.5 mg to 1 mg of glycerol per 10 mm segment of the web 44 of sheet material 18.

The thickness of the sheet material may be in the range of about 30 to 300 μm. Preferably, paper sheets will have a thickness in the range of 30 to 200 μm and sheets formed from tobacco, of which various are listed above, preferably have a thickness in the range of 50 to 300 μm, The density of the sheet material may be in the range of about 20 to 250 GSM (grams per square metre). Preferably, the various forms of sheet tobacco will have a density in the range of 50 to 250 GSM, whereas dry gel sheets preferably have a density in the range of 50 to 200 GSM, and paper sheets preferably have a density in the range of 20 to 200 GSM, more preferably between 20 and 100 GSM. Cellophane and Natureflex may have properties more closely related to paper sheets, whilst PLA and HDPE may have properties more closely related to dry gel sheets. In the case of laminates, it will be understood that each layer may have a thickness or density in the ranges described above but that the full thickness of the laminate may be outside the range stated above for a single layer material.

In embodiments where the web 44 of sheet material 18 is made from, for example, reconstituted tobacco, the aerosol generating substrate 12 and the rod segment may be integrally formed from the same plurality of elongate strips 17 of sheet material 18 extending longitudinally through the article 10. That is, both the aerosol generating substrate 12 and the rod segment 16 may be formed from the same plurality of elongate strips 17 of sheet material 18.

Figure 5:
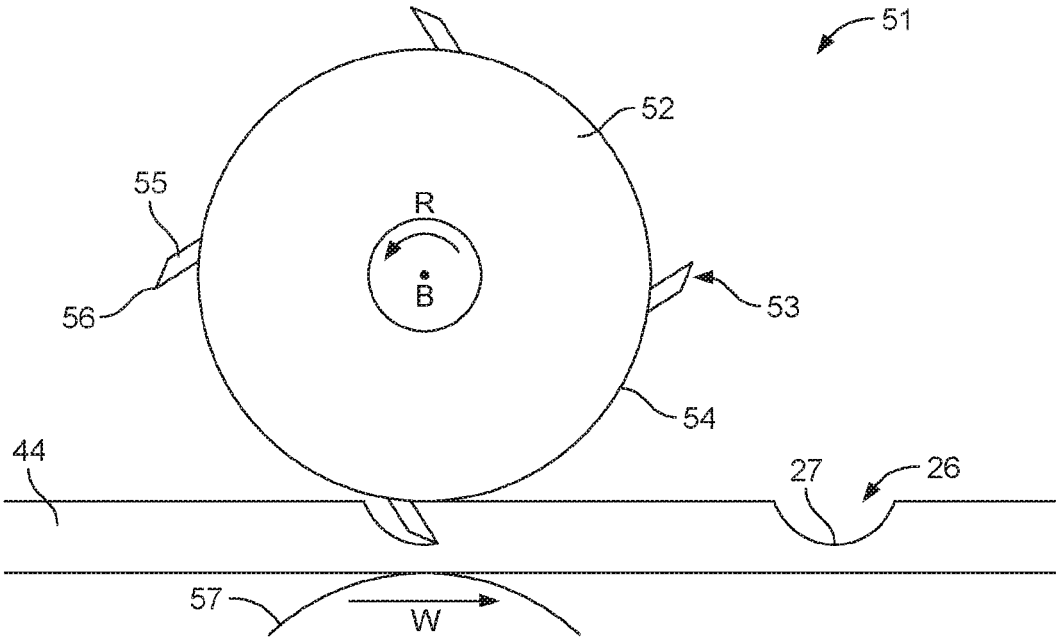
FIG. 5 shows a schematic side view of a sheet material removal station.
Figure 6:
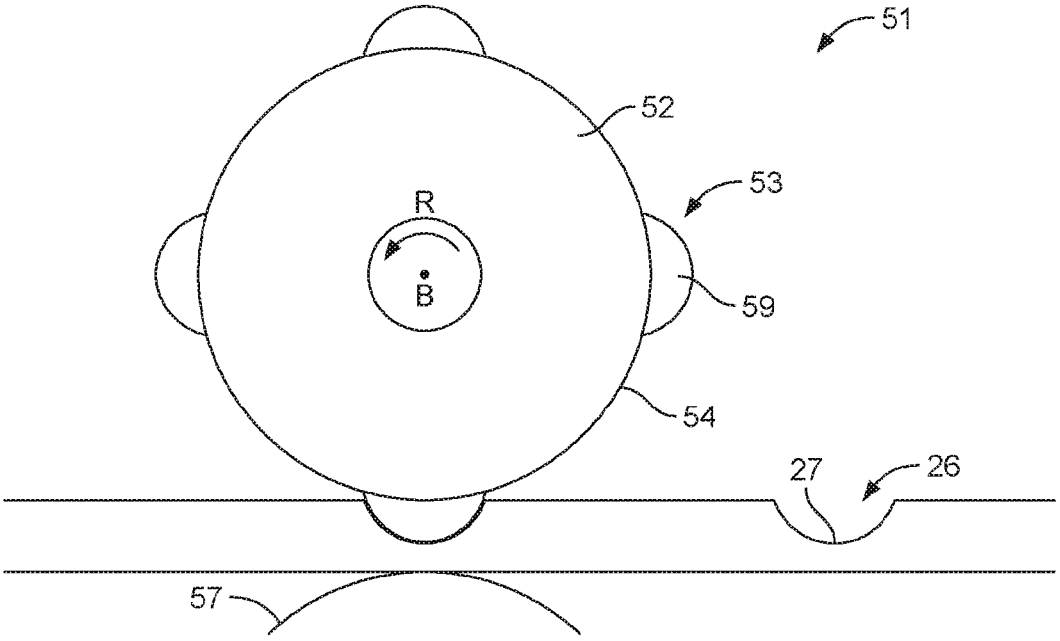
FIG. 6 shows a schematic side view of another embodiment of a sheet material removal station.

Referring to FIGS. 4, 5, and 6, the apparatus 40 may comprise a sheet material removal station 51 configured to remove sheet material from the web 44 of sheet material 18 as it passes through the sheet material removal station 51. The sheet material removal station 51 is configured to create a reduced density zone 26 in the web 44 of sheet material 18. In the present embodiment, the sheet material removal station 51 is located upstream of the first cutter 41. However, it will be understood that in an alternative embodiment, the sheet material removal station 51 may be located downstream of the first cutter 41.

The sheet material removal station 51 comprises a drum 52 configured to rotate about an axis extending perpendicularly to the web feed direction W and parallel to the width of the web 44 of sheet material 18. The drum 52 may be configured to rotate about its axis B such that the drum 52 moves in the same direction as the web 44 of sheet material 18 where the drum 52 contacts the web 44 of sheet material 18. In the present embodiment, the drum 52 is configured to rotate in the anti-clockwise direction R.

The sheet material removal station 51 also comprises a sheet material removal element 53 which is configured remove sheet material 18 from the web 44 of sheet material 18. The sheet material removal element 53 projects from a circumferential surface 54 of the drum 52. The sheet material removal station 51 is positioned such that the sheet material removal element 53 protrudes into the web 44 of sheet material 18 as the drum 52 rotates about its axis to remove sheet material 18 from the web 44 of sheet material 18.

In some embodiments, the sheet material removal station 51 creates a reduced density zone 26 in the web 44 of sheet material 18 by cutting a recess 27 into the web 44 of sheet material 18. In other embodiments, the sheet removal station 51 creates a reduced density zone 26 by displacing sheet material 18 from its original position in the web 44 of sheet material 18.

In embodiments in which the reduced density zone 26 is created by cutting sheet material 18 from the web 44 of sheet material 18, the sheet material removal element 53 comprises a cutting element 55, as shown in FIG. 5. The cutting element 55 comprises a cutting edge 56 configured to sever sheet material 18 from the web 44 of sheet material 18 to form a recess 27 in the web 44 of sheet material 18. The removal of sheet material 18 from the web 44 creates a recess 27 and reduces the density of the web 44 in the area of the recess 26 forming a reduced density zone 26 in the web 44 of sheet material 18.

The cutting element 55 may be inclined a shown, or curved, with respect to an axis perpendicular to the tangent at the point where the cutting element 55 extends from the circumferential surface 54 of the drum 52. In an alternative embodiment, the cutting element 55 may comprise a section (not shown) which is inclined or curved instead of the whole cutting element 55 being inclined.

In some embodiments, the cutting elements 55 may be configured to cut a hole (not shown) through the full thickness of the web 44 of sheet material 18. The sheet material removal station 51 may comprise an anvil roller 57, shown in FIG. 4 and partially in FIGS. 5 and 620. The anvil roller 57 may be configured to face the drum 52 carrying the sheet material removal element 53 in order to provide a surface against which the sheet material removal elements 53 can work to remove material from the sheet material 18.

In embodiments in which the reduced density zone 26 is created by displacing sheet material 18 from its original position in the web 44 of sheet material, the sheet material removal element 53 may comprise a protrusion 59, as shown in FIG. 6. The protrusion 59 may be shaped to displace sheet material 18 from its original position in the web 44 by pushing or pulling material away from its original position in the web 44. In the present embodiment, the protrusions 59 are illustrated as being generally hemispherical. However, in an alternative embodiment, the protrusions 59 may take any other shape.

The sheet material removal element 53 may comprise a plurality of cutting elements 55. The plurality of cutting elements 55 of a sheet removal element 53 may be generally spaced along the longitudinal axis of the drum 52. In the embodiments shown, the plurality of cutting elements 55 are aligned parallel to the axis B of the drum 52. Therefore, the sheet material removal station 51 can cut recesses 27 into the web 44 of sheet material 18 across the width of the sheet material 18, i.e. the dimension of the web 44 of sheet material 18 perpendicular to the web feed direction W. However, it will be appreciated that in alternative embodiments, the plurality of cutting elements 55 of a sheet material removal element 53 may be longitudinally and circumferentially spaced so as to form, for example, but not limited to, a 'zig-zag' pattern.

As shown in FIGS. 5 and 6, the sheet material removal station 51 may comprise a plurality of sheet material removal elements 53. Preferably, the plurality of sheet removal elements 53 are spaced equidistantly around the circumferential surface 54 of the drum 52. Therefore, the sheet material removal station 51 is able to cut evenly spaced recesses 27 in the web 44 of sheet material 18 so as to form evenly spaced reduced density zones 26 in the web 44 of sheet material 18.

Figure 7A:
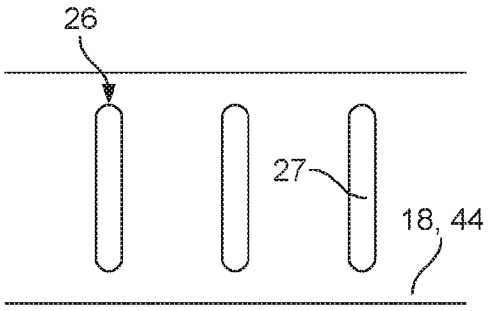
FIG. 7*a-f* show schematic top views of a sheet material with a reduced density zone.
Figure 7B:
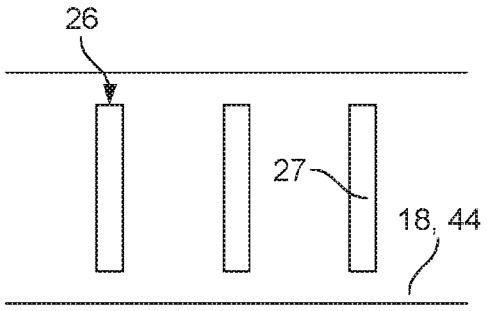
Figure 7C:
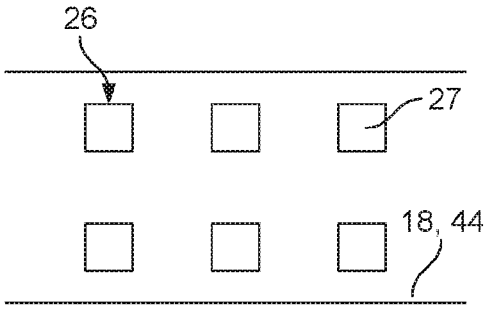
Figure 7D:
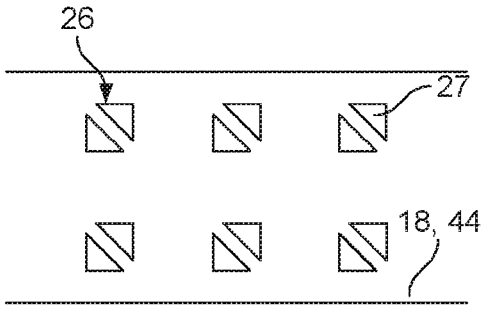
Figure 7E:
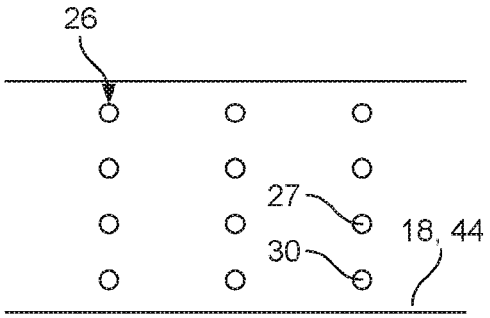
Figure 7F:
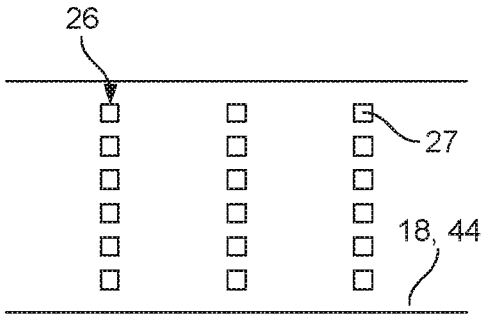

Referring briefly to FIGS. 7*a-f*, a selection of embodiments of a web 44 of sheet material 18 with recesses 27 formed in the web 44 to create a reduced density zone 26 is shown. FIG. 7*a* illustrates a single generally oval recess 27 in the web 44 of sheet material 18 forming a reduced density zone 26 spaced at a predetermined distance from adjacent reduced density zones 26. FIG. 7*b* shows a single rectangular recess 27 in the web 44 of sheet material 18 forming a reduced density zone 26 spaced at a predetermined distance from adjacent reduced density zones 26. FIG. 7*c* shows two square recesses 27 in the web 44 of sheet material 18 forming a reduced density zone 26 spaced by a predetermined distance from adjacent reduced density zones 26. FIG. 7*d* shows two sets of triangular recesses 27 in the web 44 of sheet material 18 forming a reduced density zone 26 spaced by a predetermined distance from adjacent reduced density zones 26. FIG. 7*e* shows four circular recesses 27 with reinforced areas 30 in the web 44 of sheet material 18 forming a reduced density zone 26 spaced by a predetermined distance from adjacent reduced density zones 26. FIG. 7*f* shows six square recesses 27 in the web 44 of sheet material 18 forming a reduced density zone 26 spaced by a predetermined distance from adjacent reduced density zones 26.

Figure 8:
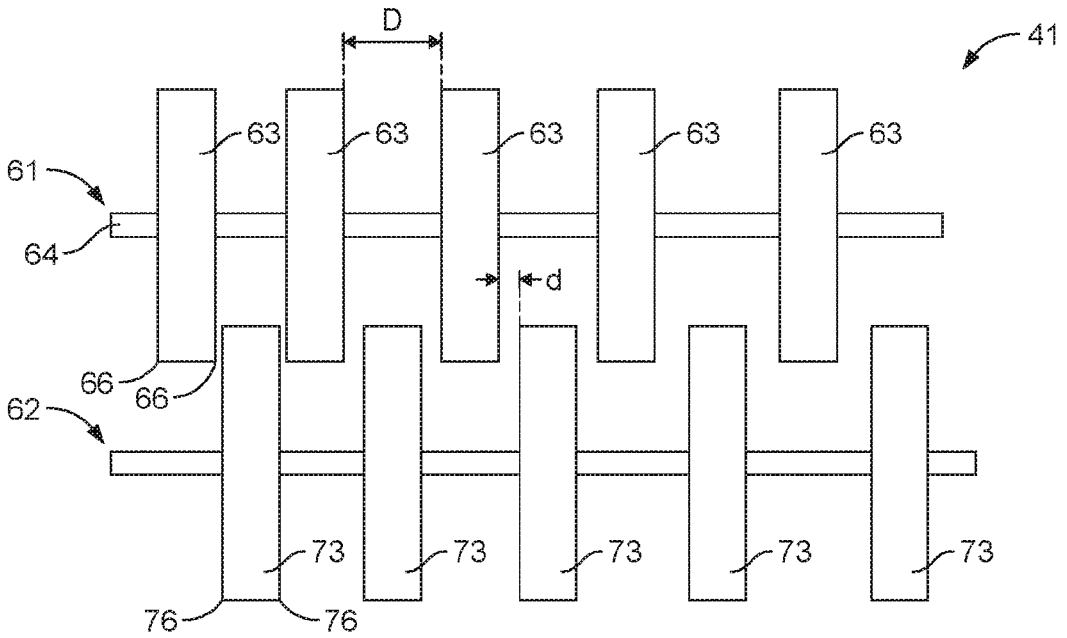
FIG. 8 shows a schematic front view of a first cutter.

Referring now to FIG. 8, a schematic front view of the first cutter 41 is shown. The first cutter 41 is arranged to cut the web 44 of sheet material 18 longitudinally to produce a plurality of elongate strips 17 of sheet material 18. The first cutter 41 comprises a first cutter array 61. The first cutter 61 may also comprise a second cutter array 62, as shown in FIG. 8 and described hereinafter.

The first cutter array 61 comprises a cutting element 63. The cutting element 63 is configured to cut longitudinal slits through the web 44 of sheet material 18. The cutting element 63 is configured to cut longitudinal slits of discrete length through the web 44 of sheet material 18. In the present embodiment, the first cutter array 61 comprises a plurality of cutting elements 63 in the first cutter array 61. The cutting elements 63 are mounted to an axle 64 which rotates each of the cutting elements 63 at the same angular velocity. The axle 64 extends transversely to the web feed direction W across the width of the web 44 of sheet material 18 and in a plane that extends parallel to the web feed direction W.

Figure 9:
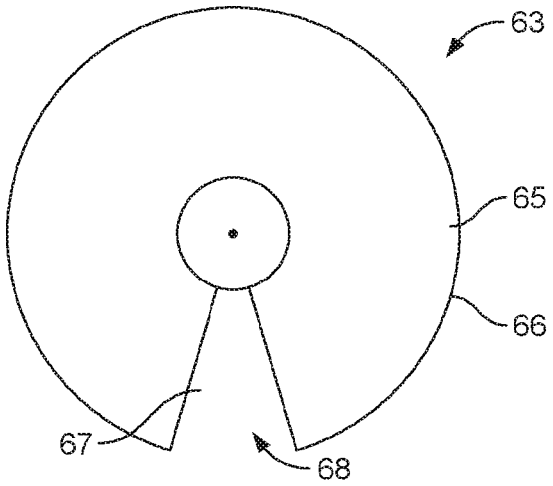
FIG. 9 shows a schematic side view of the first cutter shown in FIG. 8.

The first cutter 41 is adjustable to either cut the web 44 of sheet material 18 or to not cut the web 44 of sheet material 18 as it passes through the first cutter 41. That is, the cutting elements 63 of the first cutter array 61 are configured so that they only cut through predetermined lengths of the web 44 of sheet material 18. Referring briefly to FIG. 9, each cutting element 63 comprises a generally circular cutting disk 65. The cutting disk 65 comprises a cutting edge 66 extending around a periphery of the generally circular cutting disk 65. Therefore, the cutting edge 66 is arcuate. The cutting element 63 comprises a cut-out section 67. Therefore, the arcuate cutting edge 66 comprises a gap 68. The gap 68 in the arcuate cutting edge 66 is configured to not cut a web 44 of sheet material 18 as it passes through the first cutter array 61.

In the present embodiment, the cut-out section 67 is shown as a sector of the cutting disk 65 that has been removed. However, it will be appreciated that in alternative embodiments, the cut-out section 67 may be a different shapes, such as, for example, but not limited to, a segment, triangle, or semi-circle, etc.

The gap 68 in the cutting element 63 allows a section of the web 44 of sheet material 18 to remain uncut so that it forms a band 22 running across the width of the web 44 of sheet material 18, perpendicular to the longitudinal direction of the slits and web feed direction W. In some embodiments, the gap 68 of each of the cutting elements 63 in the first cutter array 61 are aligned such that they rotate synchronously and occupy the same angular position at the same time. Thus, the cutting elements 63 of the first cutter array 61 rotate at the same rotational speed. Preferably, the tangential speed of the cutting edge 66 of the cutting element 63 is the same as the web feed speed. This allows a band 22 of uncut sheet material to be formed extending transversely to the web feed direction W.

The rotation of the first cutter array 61 is synchronised with the rotation of the drum 52 of the sheet material removal station 51. Furthermore, the distance between the first cutter 41 and the sheet material removal station 51 is predetermined such that the gap 68 of the cutting edge 66 faces the web 44 of sheet material 18 as the reduced density zone 26 of the web 44 of sheet material 18 passes through the first cutter 41.

In alternative embodiments in which the reduced density zone 26 in the web 44 of sheet material 18 forms zig-zag pattern or a band 22 extending at an angle to the web feed direction W, due to the plurality of cutting elements 55 of a sheet material removal element 53 being offset circumferentially on the drum 52 of the sheet material removal station 51, the gaps 68 in the cutting elements 63 of the first cutter array 61 may be angularly offset so that each of the gaps 68 of each of the cutting elements 63 faces the web 44 of sheet material 18 when the reduced density zone 26 passes through the first cutter array 61 of the first cutter 41.

Referring briefly to FIG. 12, it can be seen that as a result of the gap 68 in the cutting elements 63 of the first cutter 41, a longitudinal slit is not cut into the web 44 of sheet material 18 in the reduced density zone 26 created by the sheet material removal station 51 so that the band 22 of sheet material 18 is formed. Therefore, the band 22 of sheet material 18 forms a break in the plurality of elongate strips 17 which helps to keep the elongate strips 17 of sheet material 18 extending parallel to one another. Furthermore, in the event that one of the elongate strips of sheet material 18 snaps, or otherwise breaks, the whole strip 17 is not removed from the manufacturing process.

That is, without the band 22 of sheet material 18, when one strip 17 breaks, that elongate strip 17 of sheet material 18 is normally no longer pulled through the rest of the apparatus 40. However, in the present invention, when a strip 17 between adjacent bands 22 of sheet material 18 breaks, the remaining plurality of elongate strips 17 located between the same two bands 22 of sheet material 18 are still intact and able to pull the downstream band 22 of sheet material 18 through the apparatus 40. Although the broken strip 17 may no longer be pulled through the apparatus 40, the corresponding elongate strip 17 downstream of the downstream band 22 can pulled through the apparatus 40 by the downstream band 22. Thus, a broken elongate strip 17 of sheet material 18 does not result in the complete loss of a strip 17 from the cut web 44 of sheet material 18.

Referring back to FIG. 9, the first cutter 41 comprises a second cutter array 62. The second cutter array 62 is essentially the same as the first cutter array 61 as described above and so a detailed description thereof will be omitted herein. The second cutter array 62 comprises at least one cutting element 73 which is configured to cut longitudinal slits of discrete length through the web 44 of sheet material 18. The cutting elements 73 of the second cutter array 62 are mounted to an axle 74 which rotates each of the cutting elements 73 at the same angular velocity.

The cutting elements 73 of the second cutter array 62 are configured so that they only cut through predetermined lengths of the web 44 of sheet material 18. The cutting elements 73 may comprise a generally circular cutting disk 75 and may have a cutting edge 76 that is arcuate and a cut-out section 77 which provide a gap 78 in the cutting edge 76.

The gap 78 in the cutting element 73 allows a section of the web 44 of sheet material 18 to remain uncut so that it forms a band 22 running across the width of the web 44 of sheet material 18. The gap 78 of each of the cutting elements 73 in the second cutter array 62 may be aligned such that they rotate synchronously and occupy the same angular position at the same time. In alternative embodiments, the gap 78 of each of the cutting elements 73 of the second cutter array 62 may be angularly offset.

In either case, the cut-out section 77 and gap 78 of the second cutter array 62 may be configured so that it faces the cut-out section 67 and gap 68 of the first cutter array 61 when the cut-out sections 67, 77 and gaps 68, 78 face the web 44 of sheet material 18. Therefore, the band 22 of sheet material 18 comprising the reduced density zone 26 can be created in the web 44 of sheet material 18 by the first cutter 41.

As illustrated in FIG. 9, the first cutter array 61 is located on a first side 81 of the web 44 of sheet material conveyance path and the second cutter array 62 is located on a second side 82 of the web 44 of sheet material conveyance path. The first and second cutter arrays 61, 62 may be arranged vertically.

The plurality of cutting elements 63 in the first cutter array 61 are spaced equally along the axle 64. The plurality of cutting elements 73 of the second cutter array 62 are spaced equally along the axle 74. Furthermore, the cutting elements 63, 73 of the first and second cutter arrays 61, 62 are arranged such that the cuts are formed in the web 44 of sheet material 18 by a shearing action between adjacent cutting elements 63 of the first and second cutter arrays 61, 62.

That is, the cutting elements 63, 73 of the first and second cutter arrays 61, 62 may be positioned along their respective axles 64, 74 such that the cutting elements 63, 73 from the first and second cutter arrays 61, 62 alternate across the width of the web 44 of sheet material 18. In other words, a cutting element 73 of the second cutter array 62 is located in between adjacent cutting elements 63 in the first cutter array 61 and a cutting element 63 of the first cutter array 61 is located in between adjacent cutting elements 73 in the second cutter array 62.

In the present embodiment, the plurality of cutting elements 63, 73 of the first and second cutter arrays 61, 62 are spaced evenly apart from one another. That is, adjacent cutting elements 63 of the first cutter array 61 are spaced evenly apart and adjacent cutting elements 73 of the second cutter array 62 are spaced evenly apart. Furthermore, cutting elements 63 of the first cutter array 61 are spaced evenly apart from the cutting elements 73 of the second cutter array 62. That is, the distance between adjacent cutting elements may be the same.

Cutting elements 63, 73 of the same cutter array 61, 62 may be spaced apart from each other by a distance D substantially in the range of 1 mm to 4 mm. Cutting elements 63 of the first cutter array 61 may be spaced apart from cutting elements 73 of the second cutter array 62 by a distance d substantially in the range of 0.05 mm to 1 mm.

As previously mentioned, the plurality of elongate strips 17 of sheet material 18 are formed by a shear cutting action. The width of the plurality of elongate strips 17 of sheet material 18 is determined by the width of the cutting elements 63, 73 of the cutter arrays 61, 62. That is, the cutting edges of the cutting elements 63, 73 of the cutter arrays 61, 62 are located proximate to each other in order to carry out a shear cut. Thus, each cutting element 63, 73 has two cutting edges, one on each edge proximate to an adjacent cutting element 63, 73 on the opposing array 61, 62.

Thus, a single cutting element 63, 73 cuts the web of sheet material twice by performing two shear cuts with a cutting edge of two separate cutting elements 63, 73 on the opposing array 61, 62. The distance between the cutting edges on a single cutting element 63, 73 therefore determines the width of the strip 17 cut.

Referring now to FIG. 10, a schematic front view of another embodiment of a first cutter 84 is shown. The embodiment of the first cutter 84 shown in FIG. 10 is generally the same as the first cutter 41 shown in FIG. 8, so a detailed description thereof will be omitted herein. Furthermore, similar features and components will retain their terminology and reference numbers.

The first cutter 84 shown in FIG. 10 is different to the first cutter 41 shown in FIG. 8 in that the distance between adjacent cutting elements 63, 73 are not all the same. On the contrary, the first cutter 41 comprises a first set of cutting elements 85 and a second set of cutting elements 86. The first set of cutting elements 85 are spaced apart by a first distance d1. The second set of cutting elements 86 are spaced apart by a second distance d2. The first distance d1 between adjacent cutting elements 63, 73 of the first set of cutting elements 85 is different to the second distance d2 between adjacent cutting elements 63, 73 of the second set of cutting elements 86. This is achieved by using cutting disks 65, 75 of different widths.

That is, the plurality of cutting elements 63, 73 are arranged along the axle 64, 74 with different distances between them in the widthwise direction of the web 44 of sheet material 18 due to the differing widths of the sets of cutting elements 85, 86. As shown in FIG. 10, the first set of cutting elements 85 may comprise a plurality of cutting elements 63 from the first cutter array 61 and a plurality of cutting elements 73 from the second cutting array 62. The second set of cutting elements 86 may also comprise a plurality of cutting elements 63 from the first cutter array 61 and a plurality of cutting elements 73 from the second cutting array 62. The first set of cutting elements 85 may have a first width and the second set of cutting elements 86 may have a second width, different to the first width. However, it will be understood that in some embodiments, only one cutter array may be present.

The different sets of cutting elements 85, 86 allows the web 44 of sheet material 18 to be cut into a plurality of elongate strips 17 of sheet material 18 having different widths. This may be beneficial when forming the cut web 44 of sheet material 18 into a rod 45 or when inserting a aerosol-modifying agent 33 into the rod 45. It will be understood that there may be more than two sets of cutting elements and that when there are more than two sets of cutting elements, two of the sets of cutting elements maybe spaced by the same distance.

Cutting different widths can be done into a web 44 of sheet material 18 so that the web 44 has elongate strips 17 of sheet material 18 of different widths across its width. Alternatively, or in addition, the web 44 of sheet material 18 may be fed into different sides of the first cutter 41, i.e. either through the first set of cutting elements 85 or through the second set of cutting elements 86.

Referring now to FIG. 11, a schematic front view of a further embodiment of a first cutter 88 is shown. The embodiment of the first cutter 88 shown in FIG. 11 is generally the same as the first cutter 41 shown in FIG. 8, so a detailed description thereof will be omitted herein. Furthermore, similar features and components will retain their terminology and reference numbers.

The first cutter 88 shown in FIG. 11 is different to the first cutter 41 shown in FIG. 8 in that the distances between adjacent cutting elements 63, 73 of the first and second cutter arrays 61, 62 are different. In the present embodiment, the cutting elements 63, 73 are arranged in pairs 89. Each pair 89 comprises a cutting element 63 from the first cutter array 61 and a cutting element 73 from the second cutter array 62. The cutting elements 63, 73 of pair are positioned such that they are closer together than they are to their adjacent cutting elements 63, 73. Thus, the cutting elements 63, 73 of a pair 89 are spaced by a relatively small distance d3 and adjacent pairs 89 are spaced from each other by a relatively larger distance d4 when compared to the space between cutting elements 63, 73 in a pair.

Furthermore, the first cutter 41 may be adjustable so as to adjust the distance between the cutting elements 63, 73 in order to adjust the number and/or width of elongate strips cut from a web 44 of sheet material 18. In some embodiments, the first cutter 41 may be adjustable by repositioning individual cutting elements 63, 73 along their axle 64, 74 and/or adding cutting elements 63, 73 to an axle 64, 74 and/or removing cutting elements 63, 73 from an axle 64, 74.

Referring to FIGS. 12*a-c*, schematic top views of a cut web 44 of sheet material 18 with a reduced density zone 26 can be seen for each of the embodiments discussed above. FIG. 12*a* shows a cut web 44 of sheet material 18 in which the plurality of elongate strips 17*a* of sheet material 18 all have the same width. FIG. 12*b* shows a cut web 44 of sheet material 18 in which there are two sets of elongate strips 17*b*, 17*c* of sheet material 18 having two different widths. FIG. 12*c* shows a cut web 44 of sheet material 18 in which there are pairs of elongate strips 17*d*, 17*e* having different widths.

In some embodiments, the first cutter 41 may be configured to crimp the web 44 of sheet material 18. In an alternative embodiment, the apparatus 40 may comprise a crimping station (not shown). In either case, the apparatus 40 may be configured to crimp the web 44 of sheet material 18 such that each of the plurality of elongate strips 17 of sheet material 18 has a crimped section 19.

In some embodiments, the crimping station (not shown) is upstream of the first cutter 41 and sheet material removal station 51 so that the crimping station crimps the web 44 of sheet material 18. In other embodiments, the crimping station is upstream of the first cutter 41 but downstream of the sheet material removal station 51 so that the crimping station crimps the web 44 of sheet material 18 that has reduced density zones 26 in it. In yet another embodiment, the crimping station is downstream of the first cutter 41 so that the crimping station crimps the plurality of elongate strips 17 of sheet material 18.

Referring back to FIG. 4, a schematic side view of a gatherer 42 is shown. The gatherer 42 is configured to gather the plurality of elongate strips 17 of sheet material 18 together to form a rod 45. In the present embodiment, the gatherer 42 is a funnel 91. The funnel 91 comprises a funnel portion 92 and a stem portion 93. The funnel portion 92 and the stem portion 93 are circular in cross-section and are co-axial. The funnel 91 is symmetrical about its axis. The funnel portion 92 narrows from a relatively wide mouth 94 to the relatively narrow stem portion 93. The cut web 44 of sheet material 18 travels through the funnel 91 from the funnel portion 92 to the stem portion 93. As the cut web 44 of sheet material 18 travels through the funnel 91, the narrowing diameter of the funnel portion 92 gathers the plurality of elongate strips 17 of sheet material and band 22 of sheet material 18 together to form a rod 45.

The funnel 91 is aligned with and positioned centrally of the plurality of elongate strips 17 of sheet material 18. The funnel 91 therefore gathers each of the plurality of elongate strips 17 of sheet material 18 and the band 22 of sheet material 18 substantially transversely to form the rod 45. Specifically, the funnel 91 gathers each of the plurality of elongate strips 17 of sheet material 18 towards an axis that lies centrally of the plurality of elongate strips 17 of sheet material 18. The funnel 91 being aligned with the plurality of elongate strips 17 of sheet material 18 in this way may allow the sheet material 18 to be gathered evenly and centrally of the funnel 91.

The funnel 91 is aligned with and positioned centrally of the web 44 of sheet material 18. Specifically, the axis towards which the plurality of elongate strips 17 of sheet material 18 are gathered by the funnel 91 lies in a first plane, the first plane including the web feed direction W and being perpendicular to a second plane defined by the plurality of elongate strips 17 of sheet material 18 before they are gathered. This alignment may help ensure an even tension across the plurality of elongate strips 17 of sheet material 18 as they are gathered by the funnel 91.

The funnel 91 applies substantially transverse forces to the plurality of elongate strips 17 of sheet material 18 as they passes through the funnel 91, which transverse forces are directed substantially centrally of the plurality of elongate strips 17 of sheet material 18. The plurality of elongate strips 17 of sheet material 18 are not coiled as they are gathered and remain substantially straight or parallel to one another, as they pass through the funnel 91.

In some embodiments, the gatherer 42 may be formed by a tray (not shown) having one end narrower than the other end. Therefore, the gatherer 42 may have more of a rectangular or triangular shape than the cone/funnel shape gatherer 42 described above.

In the present embodiment, the gatherer 42 is configured to gather the cut web 44 of sheet material 18 substantially transversely to form a rod 45. In some embodiments, the gatherer 42 may gather the cut web 44 of sheet material 18 so that the web 44 of sheet material 18 extends circumferentially around the rod 45. That is, the gathered 42 may be configured to gather the cut web 44 of sheet material 18 to form a rod 45 comprising a central cavity 31. The cavity 31 may be best defined in the reduced density zone 26 of the cut web 44 of sheet material 18.

Figure 13:
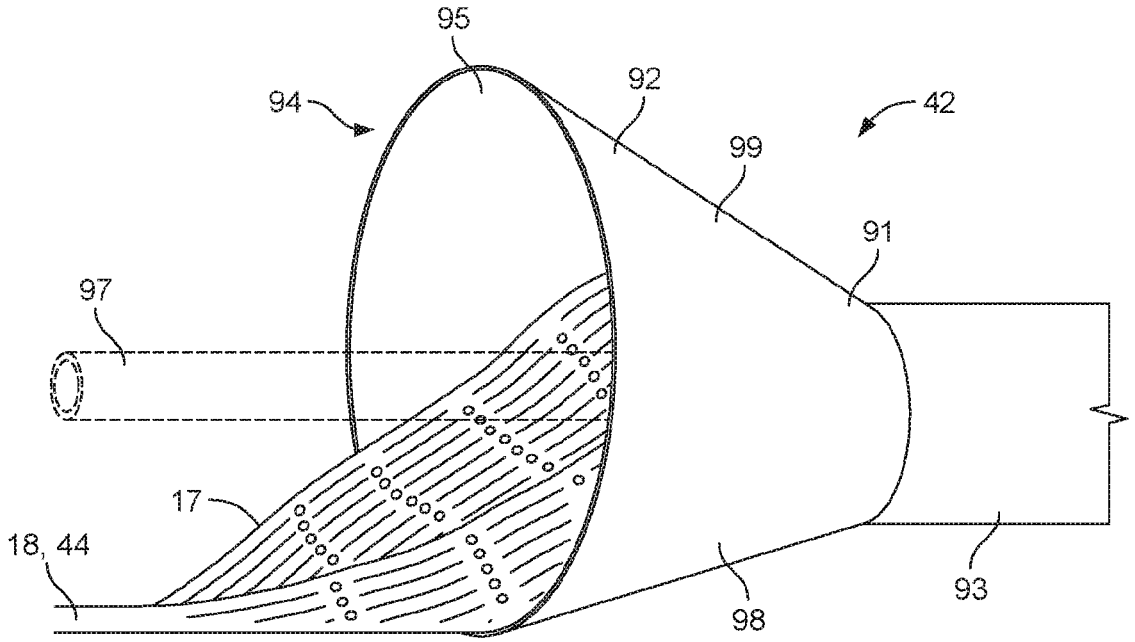
FIG. 13 shows a schematic perspective view of a gatherer.

Referring briefly to FIG. 13, a perspective view of the gatherer 42 is shown. It can be seen that as the cut web 44 of sheet material 18 moves further through the funnel portion 92 of the gatherer 42, the web 44 of sheet material 18 moves generally circumferentially around an inner surface 95 of the funnel portion 92 to form the rod 45. The band 22 of sheet material 18 helps to provide more rigidity to the cut web 44 of sheet material 18 so that the movement of the web 44 is easier to control when forming the rod 45.

The gatherer 42 is configured in order to fold the cut web 44 of sheet material 18 to form a rod 45 of sheet material 18. The gatherer 42 may be shaped in various ways to achieve different arrangements of the folds of the web 44 of sheet material 18. That is, although the gatherer 42 shown in FIG. 13 is conical, the gatherer 42 may take another form, such as, for example, but not limited to a tray (not shown). The tray may have flat lower surface and have a narrow end which forms the rod 45 as the cut web 44 of sheet material 18 passes through it.

In some embodiments, the inner surface 95 of the gatherer 42 may be profiled to encourage the cut web 44 of sheet material 18 to form a desired pattern such as, for example, but not limited to, random folding, zig-zig folding, sinusoidal folding, etc. In some embodiments, the gatherer 42 may comprise guides (not shown) on the inner surface 95 of the gatherer 42, and/or in front of the opening to the gatherer 42 to encourage the cut web 44 of sheet material to form a desired arrangement and or pattern. An advantage of using guides is that gaps between elongate strips 17 of the sheet material 18 can be encourage to make it easier to insert a capsule 33, as will be described in more detail hereinafter.

In some embodiments, the apparatus 40 further comprises a tube feeder 96, shown schematically by dotted lines in FIG. 4. The tube feeder 96 is configured to feed a tube 97, shown in dotted lines in FIG. 13, into the centre of the gatherer 42. In such an embodiment, the gatherer 42 is configured to gather the cut web 44 of sheet material 18 around the tube 97 to form a rod 45. Preferably, the tube 97 is hollow and extends longitudinally down the centre of the rod 45.

Furthermore, in some embodiments, the apparatus 40 is configured to gather a first cut web 44 of sheet material 18 together with a second cut web of sheet material (not shown). For example, as shown in FIG. 13, a first cut web 44 of sheet material 18 is fed into a bottom half 98 of the gatherer 42 and a second cut web of sheet material may be fed into a top half 99 of the gatherer 42. The rod 45 may be formed by two cut webs of sheet material which each form a half of the rod 45 or the two cut webs of sheet material may be interwoven. In the case where the two sheet materials are interwoven, the two types of sheet material may be combined prior to the cutting and/or crimping operations performed by the first cutter 41 and/or crimping station. In some embodiments, an aerosol-modifying agent 33 may be added to the cut web or cut webs of sheet material before the cut web(s) of sheet material enter the gatherer.

In some embodiments, the two types of sheet material 18 may be arranged such that the second type of sheet material 18 is located inside the first type of sheet material 18. That is, the first and second types of sheet material 18 may be arranged concentrically with the second type of sheet material 18 forming a core portion and the first type of sheet material 18 extending circumferentially around the core portion to form a sheath portion. Alternatively, the first and second types of sheet material 18 may be formed such that the first type of sheet material 18 fills one semi-circular half of the rod segment 16 and the second type of sheet material 18 fills the other semi-circular half of the rod segment 16.

As shown in FIG. 4, the apparatus 40 further comprises an aerosol-modifying agent insertion device 100. The aerosol-modifying agent insertion device 100 is located downstream of the gatherer 42. The aerosol-modifying agent insertion device 100 is configured to insert an aerosol-modifying agent capsule 33 into the reduced density zone 26 of the rod 45 of sheet material 18.

Figure 14:
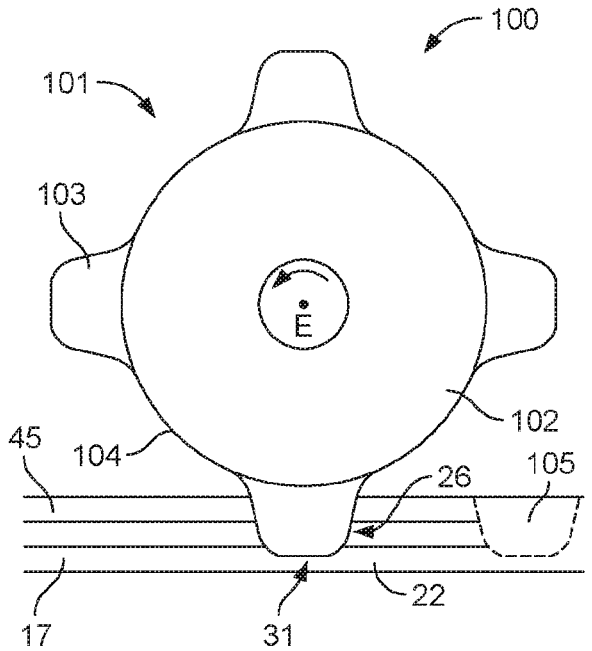
FIG. 14 shows a cavity preparation member.

The aerosol-modifying agent insertion device 100 comprises a cavity preparation device 101. The cavity preparation device 101 comprises a roller 102 configured to rotate about its central axis E. The roller 102 comprises a projection 103 extending from a circumferential surface 104 of the roller 102. The projection 103 extends radially from the circumferential surface 104 of the roller 102. The projection 103 is configured to extend into the rod 45 of sheet material 18 when rotated into contact with the rod 45 of sheet material 18 to create an opening 105, shown in dotted lines in FIG. 14, in the rod 45 of sheet material 18.

The cavity preparation device 101 may comprise a plurality of projections 103. Preferably, the plurality of projections 103 are evenly spaced around the circumferential surface 104 of the roller 102. The cavity preparation device 101 may be synchronised with the first cutter 41 so that the projections 103 always create an opening 105 in the reduced density zone 26 of the rod 45 of sheet material 18.

Figure 15:
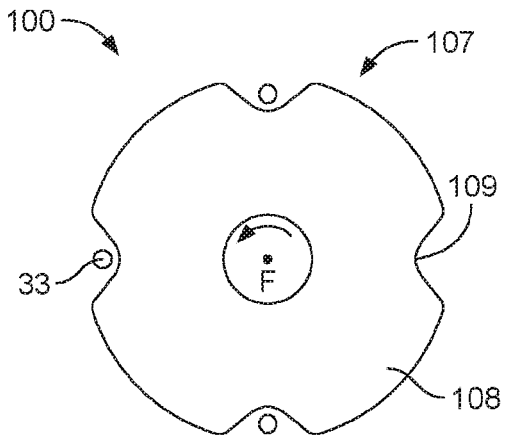
FIG. 15 shows a capsule insertion roller.

Referring to FIGS. 4 and 15, the aerosol-modifying agent insertion device 100 may further comprise a capsule inserter 107. The capsule inserter 107 is configured to insert an aerosol-modifying agent capsule 33 into the cavity 31 in the reduced density zone 26 of the band 22 of the rod 45 of sheet material 18. The capsule inserter 107 may be synchronised with the first cutter 41 so that capsules 33 are always inserted into the reduced density zone 26 in the band 22 of the rod 45 of sheet material 18.

In other embodiments, the capsule inserter 107 may additionally or alternatively insert capsules 33 in between the plurality of elongate strips 17 of sheet material 18.

Referring to FIG. 15, the capsule inserter 107 comprises a drum 108 configured to rotate about its central axis F. The capsule inserter 107 further comprises at least one pocket 109 configured to hold a capsule 33 until it is time to deposit the capsule 33 into the opening 105 created by the cavity preparation device 101. The pocket 109 may keep the capsule 33 in the pocket 109 via suction means (not shown).

The apparatus 40 may further comprises a controller (not shown) configured to synchronise the motion of the first cutter 41, the aerosol-modifying agent inserter 100, and the second cutter 43.

Referring briefly to FIG. 4, the apparatus 40 may further comprise a wrapper 111 configured to wrap the rod 45 of sheet material 18 in a wrapping material (not shown). The wrapper 111 may wrap a continuous sheet of wrapping material around a circumference of the continuous rod 45 of sheet material 18, and may apply adhesive to the wrapping material to seal the wrapping material in place around the rod 45 of sheet material 18.

Figure 16:
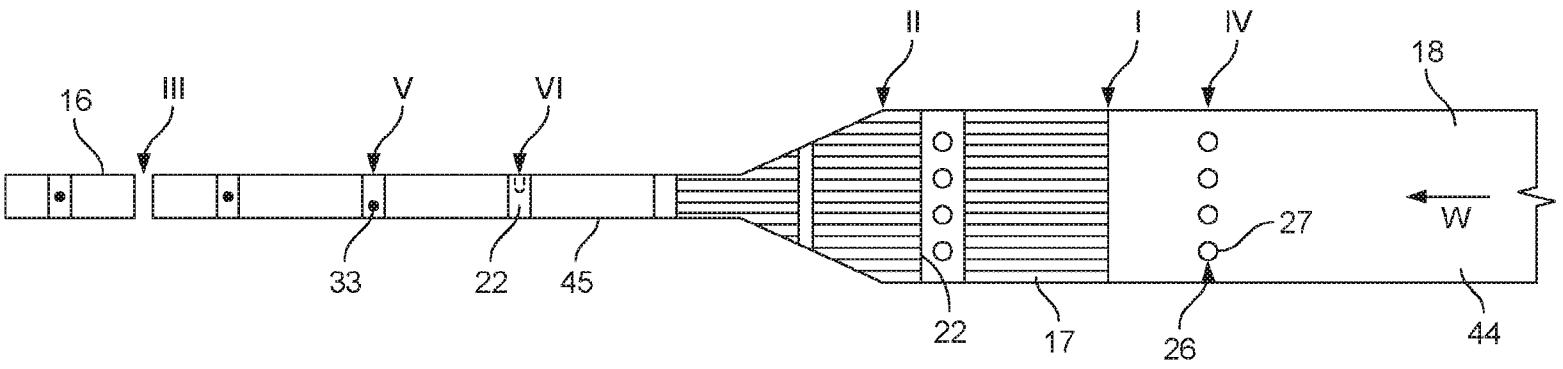
FIG. 16 shows an illustration of the process undergone by a sheet material in the apparatus shown in FIG. 4 to form rod segments for an article.

Referring to FIG. 16, an illustration of the process undergone by the web 44 of sheet material 18 in the apparatus 40 shown in FIG. 4 to form rod segments 16 for an article 10 is shown. The method of forming a rod segment 16 for a mouthpiece for an aerosol generating device component 1 comprises the step of cutting a web 44 of sheet material 18 longitudinally to produce a plurality of elongate strips 17 of sheet material 18 (step I). This step takes place at the first cutter 41.

The method further comprises the steps of gathering the plurality of elongate strips 17 of sheet material 18 to form a rod 45 of sheet material 18 in which each of the elongate strips 17 of sheet material 18 extends substantially longitudinally through the rod 45 (step II), and cutting the rod 45 of sheet material 18 into segments to produce rod segments 16 for a mouthpiece of an aerosol generating device component 1 (step III). Step B takes place in the gatherer 42 and step C takes place at the second cutter 43.

The method may further comprise cutting longitudinally extending slits of discrete length through the web 44 of sheet material 18. Therefore, the method may also comprise not cutting a discrete, predetermined length of the web 44 of sheet material 18 to form a band 22 of sheet material 18 across the web 44. This takes place at the first cutter 41 during step I.

The method may further comprise the step of forming a reduced density zone 26 in the web 44 of sheet material by removing sheet material 18 from the web 44 of sheet material 18 (step IV). In the present embodiment, step IV take place before step I. That is, the reduced density zone 26 is created in the web 44 of sheet material 18 before the web 44 is cut into a plurality of elongate strips 17 of sheet material 18. In alternative embodiments, step IV may take place after step I but before step II.

The reduced density zone 26 is created in the web 44 of sheet material 18 by cutting a recess 27 into the web 44 of sheet material 18. The reduced density zone 26 is created in a position on the web 44 of sheet material 18 which will later become the band 22 of sheet material 18. In some embodiments, the reduced density zone 26 is created in the web 44 of sheet material 18 by pushing material away from an area of the web 44 of sheet material 18. In some methods, this creates reinforced area 30 around the edge of the reduced density zone 26.

The method may further comprise inserting a tube into the gatherer 42 and gathering the cut web 44 of sheet material around the tube to form a rod 45 of sheet material 18. This step may take place with step II.

The method may further comprise the step of inserting an aerosol-modifying agent 33 into the rod 45 of sheet material 18 (step V). The aerosol modifying agent capsule 33 may be inserted into the reduced density zone 26 of the band 22 of the rod 45 of sheet material 18. In the present embodiment, inserting the aerosol-modifying agent into the rod 45 of sheet material 45 takes place after step II, gathering the web 44 of sheet material 18. However, in alternative embodiments, step V may take place before step II.

The method may further comprise the step of creating an opening 105 in the rod 45 of sheet material 18 for the aerosol-modifying agent to be inserted into (step VI). This step takes place before the capsule 33 is inserted, i.e. step VI takes places before step V.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the inventions as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, pails, steps, means, etc other than those specifically described herein. In addition, this disclosure may include other inventions not presently claimed, but which may be in future.

The invention claimed is:

1. An article comprising an aerosol generating substrate, and a region positioned longitudinally relative to the aerosol generating substrate, wherein the region comprises a rod segment formed from a plurality of elongate strips of sheet material extending longitudinally through said rod segment, wherein the rod segment further comprises a band of sheet material from which the plurality of elongate strips extend, and wherein the band of sheet material extends transversely to the plurality of elongate strips of sheet material.

2. The article according to claim 1, wherein the plurality of elongate strips of sheet material extend substantially parallel to one another, and optionally, wherein each of the plurality of elongate strips of sheet material is substantially straight.

3. The article according to any one of claim 1, wherein each of the plurality of elongate strips comprises a crimped section, and optionally, wherein the crimped section of one of the plurality of elongate strips is longitudinally offset from the crimped sections of the adjacent elongate strips.

4. The article according to any one of claim 1, wherein a first plurality of elongate strips extend longitudinally downstream of the band of sheet material through the rod segment.

5. The article according to any one of claim 1, wherein a second plurality of elongate strips extend longitudinally upstream of the band of sheet material through the rod segment.

6. The article according to any one of claim 1, wherein the band of sheet material comprises a reduced density zone, and wherein the reduced density zone comprises a recess formed by removal of sheet material.

7. The article according to claim 6, wherein the rod segment comprises a cavity formed by the reduced density zone in the band of sheet material.

8. The article according to claim 1, wherein the rod segment further comprises an aerosol-modifying agent capsule.

9. The article according to claim 6, wherein the rod segment further comprises an aerosol-modifying agent capsule, and wherein the aerosol-modifying agent capsule is located in a reduced density zone of the band of sheet material.

10. The article according to claim 8, wherein the rod segment further comprises an aerosol-modifying agent capsule, and wherein the capsule is received in the cavity formed by the reduced density zone in the band of sheet material.

11. The article according to claim 1, wherein the rod segment further comprises a tube, wherein the rod segment formed from a plurality of elongate strips of sheet material at least partially surround the tube.

12. The article according to claim 1, wherein each of the plurality of elongate strips of sheet material has a width substantially in the range of 0.25 mm to 2 mm.

13. The article according to claim 12, wherein each of the plurality of elongate strips of sheet material has a width that is substantially the same, or, wherein the plurality of elongate strips of sheet material comprises a first set of elongate strips having a first width that is substantially the same and a second set of elongate strips having a second width that is substantially the same.

14. The article according to claim 1, wherein the rod segment is formed from a first plurality of elongated strips of a first sheet material and a second plurality of elongated strips of a second sheet material, and optionally, wherein the substrate which forms the first sheet material is different to the substrate that forms the second sheet material.

15. The article according to claim 1, wherein the thickness of the sheet material is in the range of about 30 to 300 μm.

16. The article according to claim 1, wherein the density of the sheet material is in the range of about 20 to 250 grams per square metre.

17. The article according to claim 1, wherein the region positioned longitudinally relative to the aerosol generating substrate is a downstream region downstream of the aerosol generating substrate, or, wherein the region positioned longitudinally relative to the aerosol generating substrate is an upstream region upstream of the aerosol generating substrate.

18. The article according to claim 1, wherein the aerosol generating substrate and rod segment are integrally formed from the same plurality of elongate strips of the sheet material extending longitudinal through the article such that the plurality of elongate strips form both the rod segment and the aerosol generating substrate.

* * * * *